US005203472A

United States Patent [19]

Levenbaum et al.

[11] Patent Number: 5,203,472

[45] Date of Patent: Apr. 20, 1993

[54] TIMER CONTROLLED CIGARETTE DISPENSER

[75] Inventors: Warren G. Levenbaum, Phoenix, Ariz.; David Anderson, Salt Lake City, Utah

[73] Assignee: Longevity Products Corporation, Phoenix, Ariz.

[21] Appl. No.: 752,024

[22] Filed: Aug. 29, 1991

[51] Int. Cl.[5] ..... B65B 59/00

[52] U.S. Cl. ..... 221/15; 221/152; 221/281; 221/288; 131/270

[58] Field of Search ..... 131/270; 221/15, 2, 221/3, 4, 29, 76, 82, 83, 84, 90, 151, 152, 155, 281, 288; 70/272, 273; 206/257, 267

[56] References Cited

U.S. PATENT DOCUMENTS

| | | | |
|---|---|---|---|
| 1,813,935 | 7/1931 | Knee | 221/155 X |
| 2,030,992 | 2/1936 | Keller | 206/267 |
| 2,812,851 | 11/1957 | Kinnebrew | 221/15 X |
| 3,363,439 | 1/1968 | Kende | 221/15 X |
| 4,351,435 | 9/1982 | Elwert et al. | 206/267 X |
| 4,465,208 | 8/1984 | Buban et al. | 221/281 X |
| 4,750,613 | 6/1988 | Kopp | 206/267 X |
| 4,862,431 | 8/1989 | Drouin | 131/270 X |
| 4,887,739 | 12/1989 | Parker | 221/155 X |
| 4,941,570 | 7/1990 | Kruger et al. | 206/267 |

*Primary Examiner*—Robert P. Olszewski
*Assistant Examiner*—Dean A. Reichard
*Attorney, Agent, or Firm*—Cahill, Sutton & Thomas

[57] ABSTRACT

A cigarette dispenser useful for aiding a person to stop smoking utilizes a movable belt for the controlled dispensing of cigarettes. The belt has openings therein which sequentially expose the open ends of cartridge compartments containing cigarettes to permit the cigarettes to be dispensed one at a time. A timing unit in the dispenser locks movement of the belt for periods of time during which the smoker is not permitted to smoke. Actual advancement of the belt is effected by the smoker at his leisure after receiving a signal signifying the end of the non-smoking period. The timing unit is in a controlled central processing unit capable of progressively increasing the duration of non-smoking periods during the course of the quitting routine.

9 Claims, 3 Drawing Sheets

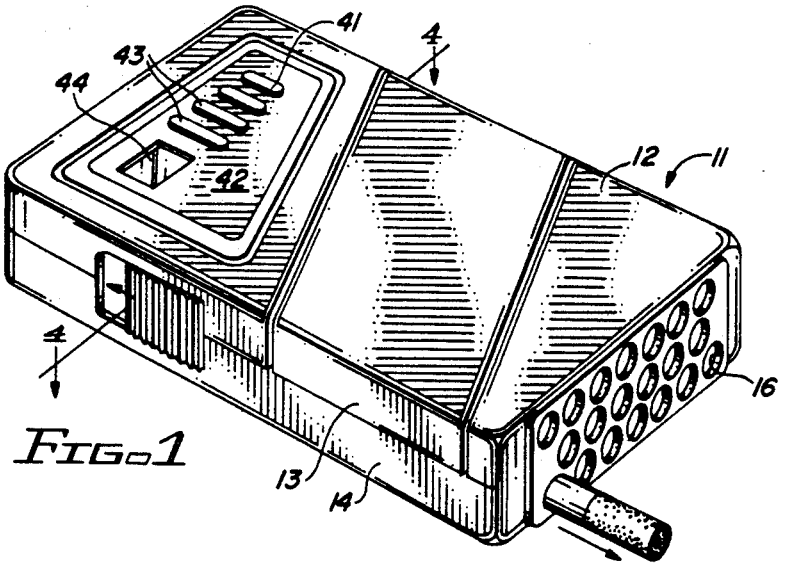
FIG. 1
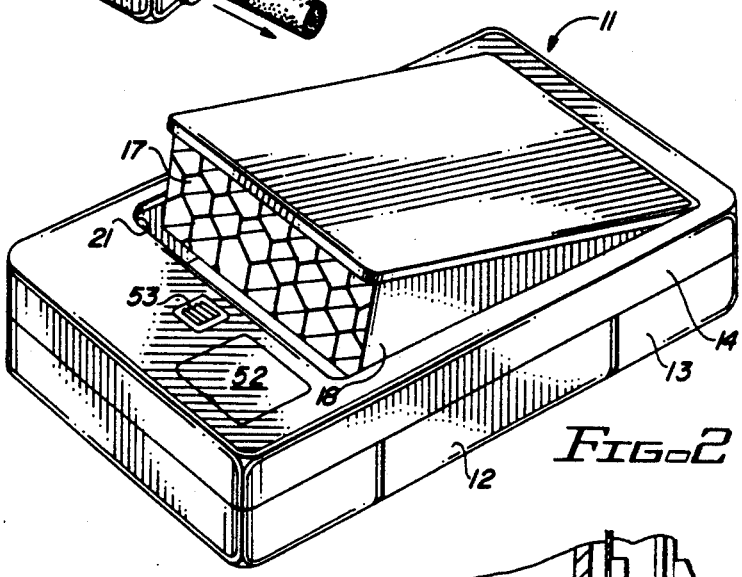
FIG. 2
FIG. 4
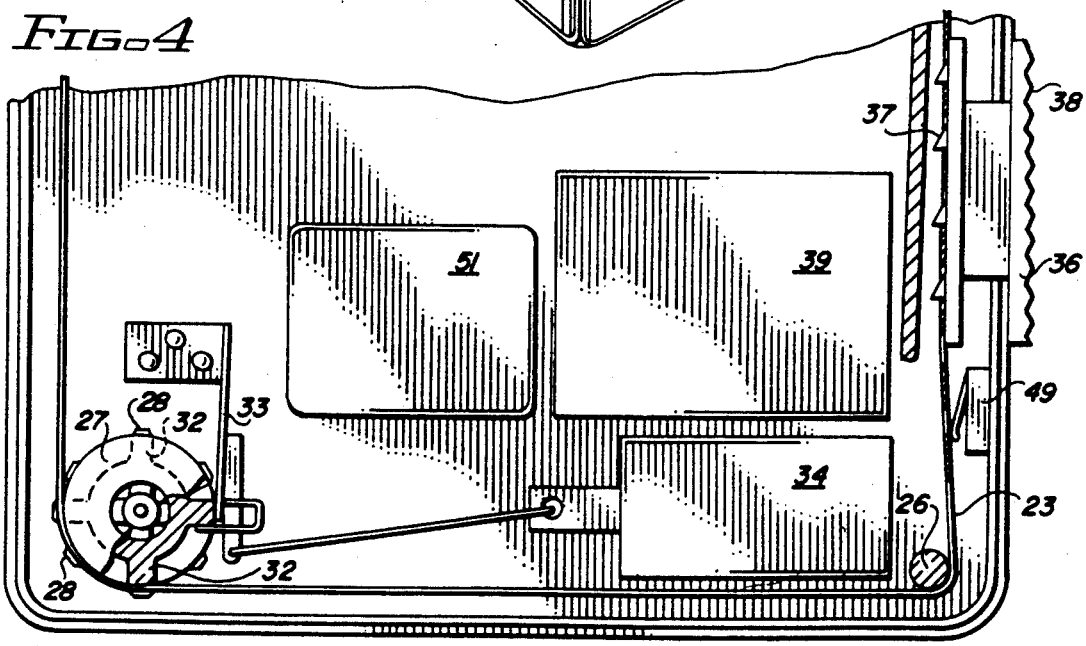

TIMER CONTROLLED CIGARETTE DISPENSER

TECHNICAL FIELD

This invention relates to apparatus for assisting a person to stop smoking.

BACKGROUND ART

Smoking tobacco is addictive. Thus, it is difficult for those persons who have acquired the habit to stop. It has long been recognized that the chances for actually stopping smoking can be enhanced by tapering off the number of cigarettes or cigars or pipe fills smoked per day over a period of time. The theory holds that when one has reduced his or her consumption to only a few smokes per day, it becomes possible to quit without an overwhelming compulsion to continue.

Prior inventors have devised a variety of timer-controlled devices to assist the addicted smoker in tapering off. And, there seem to be two schools of thought as how these devices should interact with the smoker. One school holds that tobacco should be always available to the smoker with the timer mechanism merely indicating the time period during which one or more smokes are permitted. The other school firmly believes that the smoker should be physically deprived of tobacco for predetermined periods of time.

Examples of the "always available" technique can be found in U.S. Pat. Nos. 3,424,123, granted Jan. 28, 1969, to J. A. Gifford for "Stop-Smoking Case" and 4,311,448, granted Jan. 19, 1982, to E. Strauss for "Smoking Elimination Guidance System". The Gifford case houses cigarettes and a timer-controlled bell which alerts the smoker that it is time to have another cigarette. Strauss provides a much more elaborate system which first measures the number of smoking events per day indulged by the smoker, and thereafter computes a gradual increase over time of the time periods during which a smoking event is to be permitted. Under the Strauss system, the smoker is actually free to smoke any time he or she wishes. Both Gifford and Strauss extol the virtues of the "always available" technique and demean systems in which the smoker is denied access to tobacco for various periods of time.

The "physical deprivation" school has been much more popular with inventors in this country. U.S. Pat. Nos. 2,016,534, granted Oct. 8, 1935, to W. V. Blackwell, et. al. for "Cigarette Case" and No. 2,681,560, granted Jun. 22, 1954, to V. C. Shuttleworth, et. al. for "Cigarette Case Having a Timer-Controlled Locking Means" both disclose cigarette cases with a timer controlling the opening of access means on the case. Both inventors provide mechanisms for changing the length of the time period during which the access means are locked closed.

W. O. Kinnebrew in his U.S. Pat. No. 2,812,851, granted Nov. 12, 1957, for "Time-Controlled Cigarette Case" suggests providing multiple, open-ended compartments for storing individual cigarettes. He provides a sliding closure member over the open ends of the compartments and slowly withdraws the closure member with a clockwork to expose individual cigarettes at timed intervals. The clockwork has an adjustment to permit the length of the intervals to be changed.

U.S. Pat. No. 3,206,957, granted Sep. 21, 1965, to J. Reitzes for "Cigarette Case" discloses a case equipped with a hand-wound timer, much like a cooking timer, to control movement of a member which blocks an egress opening in the case.

A lighter having a time lock thereon for disabling the lighter for set periods of time is disclosed in U.S. Pat. No. 3,744,953, granted Jul. 10, 1973, to H. C. Herr for "Cigarette Lighter with Time Lock".

Notwithstanding the efforts of these prior inventors, there continues to be a need for a reliable apparatus and a system for time controlled dispensing of cigarettes which are user-friendly and interact with the smoker to assist him or her in stopping smoking.

DISCLOSURE OF THE INVENTION

This invention provides a pocket size, hand-held dispenser capable of holding a pack of 20 cigarettes and reliably dispensing individual cigarettes at timed intervals determined jointly by a timing mechanism in the dispenser and the smoker who is endeavoring to quit smoking.

The dispensing apparatus includes a flexible belt having openings therein which move across the open ends of cartridge compartments containing cigarettes. Movement of the belt allows one cigarette at a time to be dispensed. Timing means contained within the dispenser determines the minimum amount of time which must be allowed to elapse between smoking consecutive cigarettes by blocking movement of the belt until that time has elapsed. The timing means then alerts the smoker to the availability of another cigarette and conditions the belt for movement. The smoker makes the decision as to when he wishes to smoke and manually moves the belt to a new dispensing position when he desires to do so.

BRIEF DESCRIPTION OF THE DRAWINGS

The invention is disclosed in greater detail hereinafter by reference to the accompanying drawings, wherein:

FIG. 1 is a top perspective view of the cigarette dispensing apparatus of the invention;

FIG. 2 is a bottom perspective view of the apparatus illustrating how cigarettes are loaded into a storage cartridge in the apparatus;

FIG. 4 is a fragmentary sectional view through the apparatus taken as indicated by line 4—4 in FIG. 1;

BEST MODE FOR CARRYING OUT THE INVENTION

Figure 3:
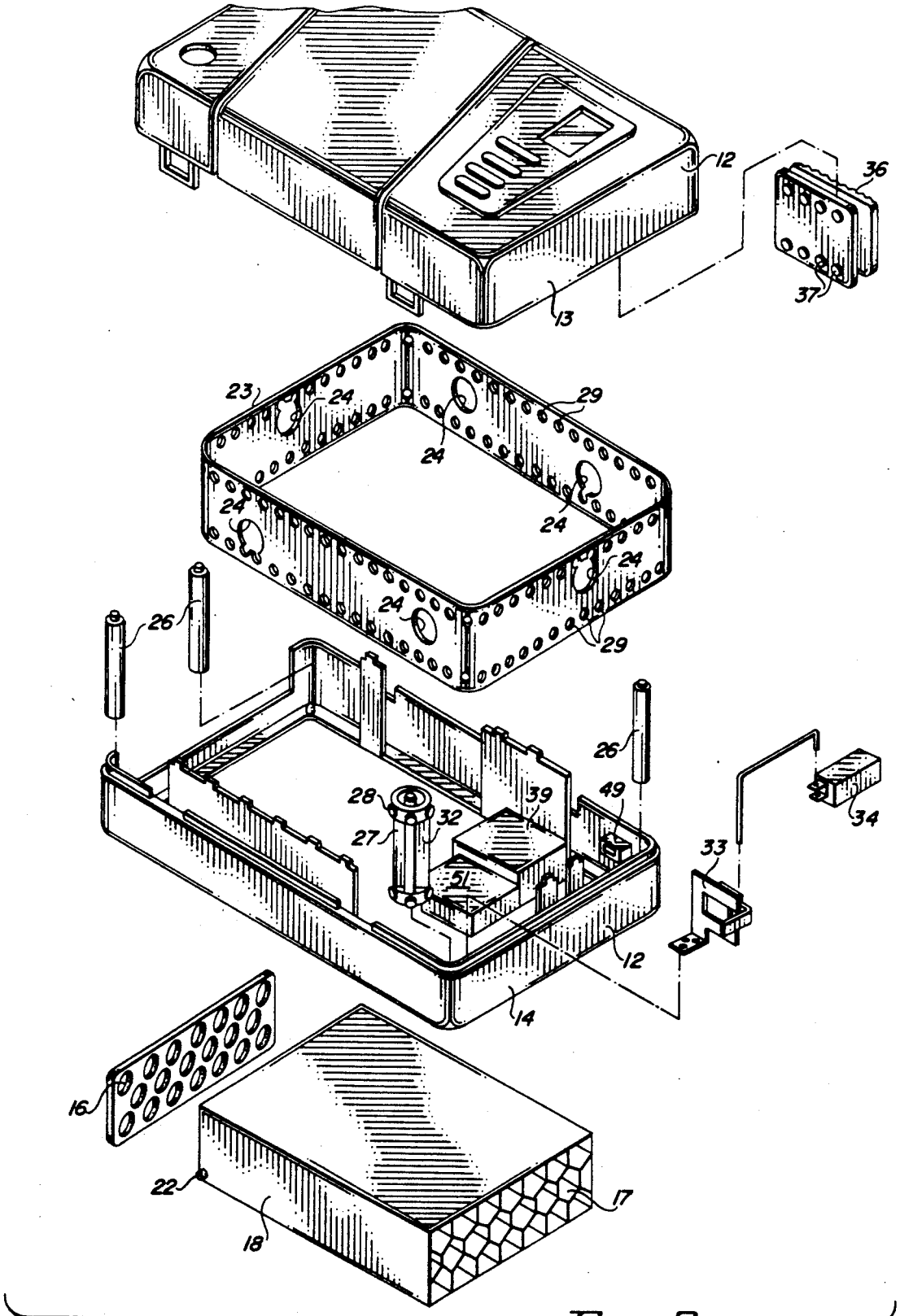
FIG. 3 is an exploded view illustrating the principal components of the apparatus.

Referring particularly to FIGS. 1-3, the dispenser of the invention is designated generally by reference numeral 11 and has an outer case, or casing, 12.

Case 12 is preferably molded from plastic material in two halves, an upper half 13 and a lower half 14. Case 12 is of a size to be comfortably held in one hand and easily slid into a coat pocket or purse. One end of the case 12 has opening means 16 therein through which cigarettes are dispensed. The opening means 16 may take the form of a perforated plate as shown in the drawings or it may simply be a sizable rectangular opening in the end of the case. In either case, the opening means 16 allows egress of cigarettes from multiple compartments 17 in a storage cartridge 18.

Cigarette storage cartridge 18 has one surface 19 thereof flush with the bottom of the lower half 14 of case 12 and fits within a second opening means 21 in the case. Cartridge 18 is preferably pivotally mounted within case 12 by means of trunnions 22 so that the cartridge can be opened outwardly from the casing 12 to expose open ends of the compartments therein for loading cigarettes into the dispenser. Cigarettes are actually dispensed from the cartridge 18 through the opposite open ends of the compartments 17, through opening means 16 in the end of case 12.

One at a time dispensing of cigarettes through opening means 16 in case 12 is controlled by a movable belt 23 adapted to traverse the open ends of cartridge compartments 17 between the cartridge 18 and the opening means 16. Belt 23 has a series of openings 24 therein which are adapted to line up with the open ends of the three layers of compartments 17 in cartridge 18 as the belt is moved past the compartments. The disposition and spacing of belt openings 24 is such that with equal incremental advancement of belt 23, one belt opening exposes a first compartment in a first row, then a following belt opening exposes a first compartment in a second row and a further belt opening exposes a first compartment in the third row. Further incremental movement of belt 23 exposes a second compartment in the first row, then a second compartment in the second row, and then a second compartment in the third row, and so on, in the same sequence until all the compartments have been exposed to permit egress of cigarettes therefrom.

Actual dispensing of the cigarettes is accomplished by gravity. With a belt opening 24 exposing a compartment 17 having a cigarette therein, the dispenser 11 is up-ended and the cigarettes falls free of the dispenser.

Belt 23 is preferably made from a tough, flexible sheet material, such as the polyester plastic material sold by E. I. DuPont DeNemours & Co. under the trademark Mylar. This material also has an unctuous surface which permits the belt to slide over the ends of contacted cigarettes without damaging the cigarettes. Belt 23 also preferably is made from transparent material to permit visual inspection of the compartments 17 in cartridge 18. This provides the smoker with one means for readily determining the number of cigarettes remaining in the dispenser.

Dispensing control belt 23 is endless and traverses the inner perimeter of case 12 around the cartridge 18 and the other internal components of the dispenser 11. The belt is guided through this path of movement by guide rollers 26 positioned at three of the corners of the case 12 and a sprocket roller 27 positioned in the fourth corner. Teeth 28 on sprocket roller 27 mate with and enter rows of holes 29 along the edges of the belt 23.

Sprocket roller 27 forms part of means for selectively preventing movement of dispensing control belt 23. It should be obvious that with sprocket teeth 28 engaging the holes 29 in belt 23, if sprocket roller 27 is prevented from turning, the belt 23 cannot be moved. The mechanism for locking sprocket roller 27 against rotation includes a spring-mounted dog 31 which is engageable with vertical flanges 32 in the body of the sprocket roller. A spring arm 33 by which dog 31 is mounted on the case lower section permits the dog to be drawn away from the flanges 32 on roller 27 by means of a solenoid 34 to unlock the roller 27 and permit movement of belt 23.

Dispensing control belt 23 is advanced by the smoker by means of a thumb-actuated advancement slide 36. Slide 36 has a series of teeth 37 on the inner face thereof sized and positioned to engage the series of holes 29 along the edges of the belt 23. When the smoker engages the outer, exposed, serrated surface 38 of slide 36 and moves the slide forward (downwardly as viewed in FIG. 4), the belt is moved a distance equal to the distance moved by the slide. Slide 36 is spring-biased (the spring is not shown) to return to its starting position and during its return movement the cam-like outer surfaces of teeth 37 cause the teeth to ride out of the belt openings 29 and enter a new set of openings when the slide comes to rest.

Energization of solenoid 34 to unlock sprocket roller 27 for advancement of belt 23 is under the joint control of the smoker and a timer (not shown separately) in a central processing unit (CPU) 39. As is well known, a CPU is a mini-computer programmable to perform specific computations and generate specific output. Programming and control of the CPU 39 is effected by the smoker utilizing a keyboard 41 which is a part of a control panel 42 on one of the broad faces of the dispenser. Control panel 42 presents a series of buttons 43 forming a part of the keyboard 41 and also presents a visual display 44, preferably of the liquid crystal type.

Figure 6:
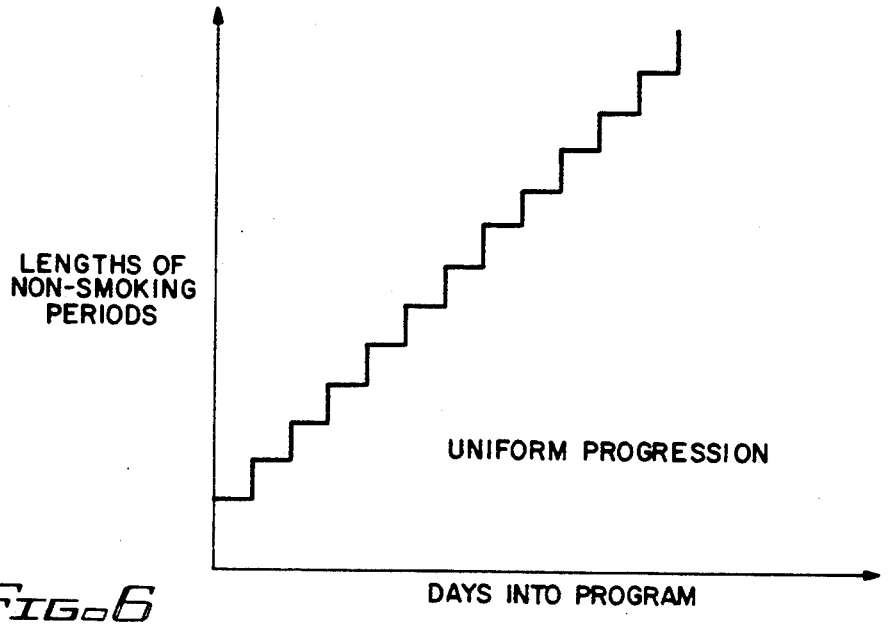
FIGS. 6 and 7 illustrate two different approaches to progressively increasing non-smoking periods utilizing the apparatus of the invention.
Figure 7:
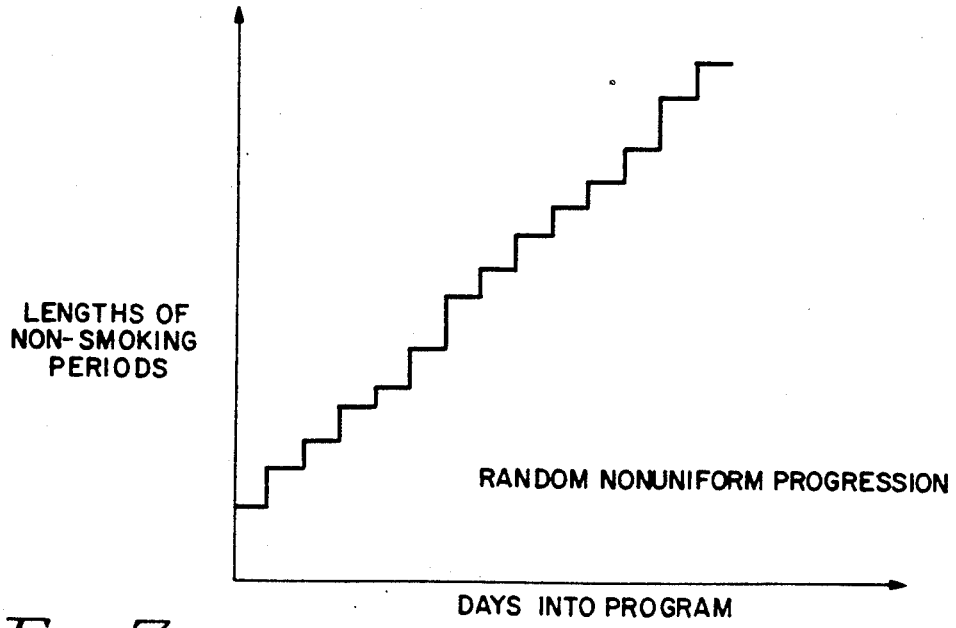

CPU 39 is capable of being programmed to (1) emit a signal upon expiration of a predetermined period of time during which the smoker is not permitted to smoke and (2) alter the length of these non-smoking time periods over a greater period of time during the course of the stop smoking regimen. In other words, the CPU 39 gradually, progressively increases the length of the periods during which the smoker is denied access to a cigarette from the dispenser 11. These non-smoking periods may be lengthened in equal increments or they may be lengthened in random, non-equal increments, depending upon how the CPU 39 is programmed. The differences between the two forms of progression are illustrated in FIGS. 6 and 7. The random, non-equal increments, as illustrated in FIG. 7, are preferred because it is believed that they assist in breaking down the pattern of tobacco dependency.

Figure 5:
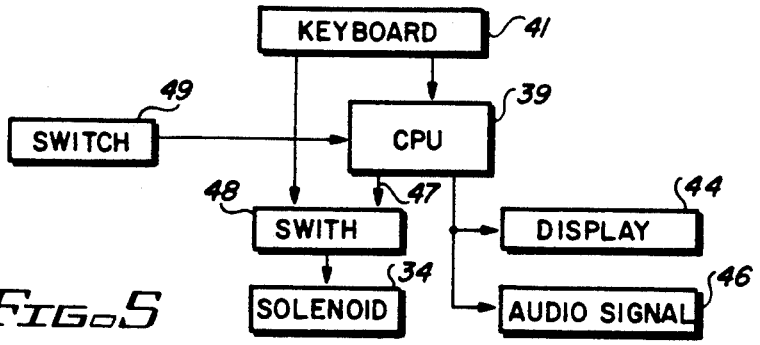
FIG. 5 is a block diagram depicting the cooperation between the various electrical components of the apparatus.

FIG. 5 diagrammatically illustrates how the various electrical components of the dispensing system co-operate. The signal emitted by the CPU 39 at the end of a non-smoking period is communicated to the smoker via the display 44 and also via an audio signal device 46, such as a buzzer. This same signal from the CPU is also conveyed over an electrical path 47 toward the solenoid 34. This signal, in effect, arms, or conditions, solenoid 34 for activation.

It will be recalled that activation of solenoid 34 is actually under the joint control of the CPU 39 and the smoker. When a non-smoking period ends and the smoker has been alerted to that fact, the smoker need not necessarily dispense and smoke a cigarette at that time. If it is inconvenient to smoke at that time, or if the smoker just does not feel like having a cigarette, he or she can wait an indefinite period before energizing the solenoid 34 by pressing one of the buttons 43 on the keyboard 41 to close a smoking switch 48 completing the circuit to the solenoid. This unlocks sprocket roller 27, allowing the dispensing control belt 23 to be advanced by the thumb slide 36.

Upon advancement of dispensing control belt 23 to dispense a cigarette, it is required to have some means for de-energizing solenoid 34 and for instructing the CPU 39 to commence timing a new non-smoking period. One such means for this purpose may take the form of a belt advance switch 49 which sends a signal to the CPU 39 to de-energize solenoid 34 and commence a new timing period when the belt has been advanced.

Electrical energy to power the CPU 39 and solenoid 34 is preferably provided by a set of batteries (not shown) housed in a battery compartment 51 which is accessible through a door 52 in the bottom of the dispenser.

Another feature of the dispenser of this invention involves means (not shown) for locking the cartridge 18 in closed position until all 20 cigarettes are used. This can be accomplished by detecting the number of times the dispensing control belt 23 is advanced and unlocking a latch 53 holding the cartridge 18. Manual movement of latch 53 then opens the cartridge so that it can be filled with a fresh pack of cigarettes.

Further features of the dispenser which may enhance the interface between the smoker and the dispenser include programming the CPU 39 to signal the display 44 to present on command information concerning, for example, the number of cigarettes remaining in cartridge 18, the amount of time remaining in the then current non-smoking period, the number of days remaining in the quit smoking program, and the time of day. The programming of a CPU 39 to accomplish these results is well within the knowledge and skills of those skilled in the art of central processing units and, therefore, need not be disclosed in greater detail herein.

From the foregoing, it should be apparent that this invention provides a time-controlled cigarette dispenser which is capable of reliably dispensing cigarettes and which offers a multi-feature, friendly interface with the smoker who is trying to quit smoking.

What is claimed is:

1. Cigarette dispensing apparatus comprising a case, a multi-compartment cartridge in said case for storing cigarettes therein, the compartments in said cartridge being arranged in multiple rows, said case having opening means therein permitting cigarettes to be removed from said case through the opening means, and a belt in said case having a run thereof passing between said cartridge and the opening means in said case, said belt having openings therein which are advanced along the rows of compartments in said cartridge to permit removal of cigarettes one at a time, the spacing of the openings in said belt being such that all of the compartments in said cartridge are sequentially exposed one at a time with equal incremental unidirectional advancements of said belt.

2. The apparatus of claim 1, further characterized in that said case has second opening means therein providing access to said cartridge to load cigarettes in said cartridge.

3. The apparatus of claim 1, further comprising manually movable means accessible outside said case for moving said belt.

4. The apparatus of claim 3, further comprising locking means for preventing movement of said belt and means including a timer for conditioning release of said locking means after the passage of predetermined intervals of time.

5. The apparatus of claim 4, further comprising means operable on said timer for altering the said predetermined intervals of time.

6. The apparatus of claim 4, further comprising a solenoid for actuating said locking means, an electrical circuit between said timer and said solenoid, and a manually actuated switch in said circuit.

7. The apparatus of claim 1, further characterized in that said belt is made of a transparent material permitting visual inspection of the contents of said cartridge.

8. The apparatus of claim 1, further characterized in that said belt is an endless belt surrounding said cartridge.

9. The apparatus of claim 1, further characterized in that said cartridge is at least partially removable from said case to permit cigarettes to be loaded therein.

* * * * *